US010982927B2

(12) United States Patent
Bonesteel

(10) Patent No.: US 10,982,927 B2
(45) Date of Patent: Apr. 20, 2021

(54) FIREARM ACCESSORY HAND GUARD

(71) Applicant: Christopher Michael Bonesteel, Brownstown, MI (US)

(72) Inventor: Christopher Michael Bonesteel, Brownstown, MI (US)

( * ) Notice: Subject to any disclaimer, the term of this patent is extended or adjusted under 35 U.S.C. 154(b) by 0 days.

(21) Appl. No.: 16/679,202

(22) Filed: Nov. 9, 2019

(65) Prior Publication Data

US 2020/0149841 A1 May 14, 2020

Related U.S. Application Data

(60) Provisional application No. 62/758,131, filed on Nov. 9, 2018.

(51) Int. Cl.
*F41C 23/16* (2006.01)
*F41G 11/00* (2006.01)

(52) U.S. Cl.
CPC ..... *F41C 23/16* (2013.01); *F41G 11/003* (2013.01)

(58) Field of Classification Search
CPC ..... F41C 23/16; F41C 23/14; F41C 23/18; F41G 11/003
USPC ..... 42/71.01, 72, 73
See application file for complete search history.

(56) References Cited

U.S. PATENT DOCUMENTS 9,574,852 B1 * 2/2017 McKillips ..... F41G 11/003
2017/0059273 A1 * 3/2017 Geissele ..... F41C 23/16

* cited by examiner

*Primary Examiner* — John Cooper
(74) *Attorney, Agent, or Firm* — Malone IP Law; Steven J. Malone

(57) ABSTRACT

A hand guard of a firearm for receiving an accessory of the firearm includes: one or more Picatinny accessory rails running longitudinally along a barrel of the firearm; a linear cavity parallel to the barrel of the firearm and parallel to an accessory receiving surface of the one or more Picatinny accessory rails; the one or more Picatinny accessory rails including one or more through holes fluidly connecting the linear cavity to the accessory receiving surface; and wherein the one or more Picatinny accessory rails includes a flange facing toward the linear cavity and running parallel to the barrel of the firearm, the flange including a track with a flat surface as a guide for a nut or ferrule for attaching the accessory of the firearm to the one or more Picatinny accessory rails of the hand guard.

18 Claims, 5 Drawing Sheets

FIREARM ACCESSORY HAND GUARD

RELATED APPLICATIONS

This application claims priority to U.S. Provisional Application Ser. No. 62/758,131 titled "Firearm Accessory Hand Guard" filed on Nov. 9, 2018 which is hereby incorporated by reference, in its entirety, for all it teaches and discloses.

BACKGROUND

Hand guards with MIL-STD-1913 rails (also referred to as Picatinny rail hand guards) have seen wide use on firearms since their invention, the MIL-STD-1913 attachment system is widely lauded for its attachment strength, standardized small increment longitudinal attachment positions, repeatability of attachment position, and its inherent quick attach/detach capability. However hand guards with MIL-STD-1913 rails have long been viewed as having 2 major drawbacks when compared to simple non accessory mounting hand guards. Those being bulk, and weight. The bulk, or width of these hand guards has been considered necessary to allow versatility in accessory attachment, due to the attachment clamps surrounding the dovetail. In order to provide clearance for the clamps surrounding the dovetail, the specification calls for 0.367" minimum clearance from the outermost plane of the rail to any obstructions located inward from that plane. If adjacent rails are placed too close to each other, the clamp from one mounted accessory can create an obstruction preventing the mounting of an accessory on an adjacent rail. To avoid this interference, manufacturers typically space the outermost plane of the rails between 1" and 1.25" from the centerline of the firearms barrel, leading to a typical industry standard of between 2" and 2.5" wide hand guards, whereas a standard non accessory mounting hand guard typically has a width of 1.5" to 1.75" for comfort. The weight is an inherent byproduct of the bulk, as a larger hand guard contains more material, also the rail profile themselves comprise a significant amount of material that would otherwise be unnecessary on a non-accessory mounting hand guard. Several methods have been used to address the weight and bulk issues associated with Picatinny rail hand guards, while still maintaining the ability to attach accessories.

One common method is to limit the attachment rails to small sections of the hand guard, in areas where it is most likely for someone to attach an accessory, and make the rest of the hand guard narrower/less bulky, for hand placement. This however limits the locations for both accessory mounting, and comfortable hand placement, significantly decreasing the modularity of the system.

Another common and increasingly popular method, is to forgo the MIL-STD-1913 rails altogether, in favor of a narrower hand guard with specific shaped holes to which accessories can be bolted directly, either by a nut and bolt, or a bolt that threads directly into the holes in the hand guard. The two most popular of these attachment methods are the Key-Mod and M-Lok systems. This method solves the weight and bulk issues associated with Picatinny rail hand guards, but introduces other issues, such as the following: The bolt on accessory attachments are typically not as strong, not as quick to attach/detach, nor as repeatable as MIL-STD-1913 attachments.

The incremental longitudinal spacing of these systems is typically much larger than the 0.394" of the MIL-STD-1913 rail, the two most popular systems have twice the distance between increments. The hand guards designed for direct bolt on accessories can easily become too hot to comfortably hold, due to several factors; They are typically narrower placing them closer to the source of the heat (the firearms barrel), and are constructed with far less surface area than a hand guard with MIL-STD-1913 rails, which dissipates the heat to the atmosphere.

To increase modularity, these systems usually include sections of MIL-STD-1913 rail that bolt on, however, where the rails are bolted on the bulk is increased, and the weight of those sections is significantly more than the weight of a similar length section of a hand guard with integral MIL-STD-1913 rail, due to the attachment hardware.

One method attempting to increase the modularity of attachment systems has arisen U.S. Pat. No. 9,599,439B1 Which adds direct bolt on attachment provisions to the MIL-STD-1913 rails on the hand guard, allowing users to attach accessories that were designed for either system. This method, however does not address the 2 major drawbacks inherent in typical Picatinny rail hand guards. Additionally this particular method compromises the standard 0.394 spacing between longitudinal attachment positions, requiring that some recoil grooves be omitted, or repositioned to provide purchase for the nut used to attach bolt on accessories. It is also more difficult to manufacture, requiring an undercut or rabbet be made on the inside portion of the rail in which to house the nut used for accessory attachment.

This invention solves the inherent bulk issue with Picatinny rails, by moving the outermost plane of the rails inward towards the barrel, while still allowing for attachment of accessories at the same longitudinal position on adjacent rails, either by means of one MIl-STD-1913 clamp and one bolt on accessory, or two bolt on accessories. It mitigates the weight issue, both by decreasing the bulk, and by the addition of the holes for bolt on accessory mounting. Additionally, this invention mitigates both the heat issue of hand guards with bolt on accessory attachments by retaining the increased surface area of the MIL-STD-1913 rail, and the drawbacks of the bolt on accessory mounts, by allowing for MIL-STD-1913 clamps to be used where the superior attachment method is needed.

SUMMARY

The present invention is a MIL-STD-1913/through bolt accessory mounting hand guard for firearms. This invention presents a novel way of attaching accessories to a firearm by using a MIL-STD-1913 dovetail clamp or by using a through bolt with a nut or ferrule on a single accessory rail. This invention consists of a hand guard for a firearm, which partially, or completely surrounds the barrel of a firearm, that has accessory mounting rails around its perimeter running lengthwise parallel or near parallel with the barrel of the firearm, see for example FIG. 1 rails 106. These rails are typically, but not limited to being, placed at the 3:00, 6:00, 9:00 and sometimes 12:00 position. The outer profile of the rails contains a dovetail, which conforms to MIL-STD-1913 or specifications of a Picatinny rail (see FIG. 2, outer rails 204, 206, 208, and 214). The outermost plane of this profile can be positioned as close as 0.7845" from the centerline of the barrel. The inner profile creates a linear cavity (see FIG. 2, linear cavity 210) that can be used to house a nut or ferrule, for an accessory, or accessory bolt to thread into. The rails have a series of lateral "recoil grooves" (shown in FIG. 5, recoil grooves 516) formed into them with a longitudinal center to center spacing of 0.394" between each adjacent groove 516. Each of these grooves is considered an attachment position for an accessory. The material fore and aft of each recoil groove shall be considered "recoil lugs" (see FIG. 5, recoil lugs 518). The rails have a series of holes or slots, running longitudinally, with all or part of a recoil lug immediately fore and aft of the front and rear edges of all holes or slots (see FIG. 5, holes or slots 508). The holes or slots are centered laterally on the rails, with the lateral width of the slots being narrower than the linear cavity created by the inner profile of the rail, by enough margin, that a nut or ferrule placed inside the linear cavity can purchase on the material between the lateral edges of the hole or slot and the inner profile of the rail (see FIG. 4, lateral edges or lips 416), to prevent the nut or ferrule from pulling through the hole. This hand guard is typically, but not limited to being made from extruded aluminum, and can be manufactured to fit a variety of different firearms. One such version is for the AR-15 series of rifles (shown in FIG. 1), that attaches to the firearm via a proprietary barrel nut, that has radial threaded holes, to which the hand guard bolts directly (See FIG. 1). Another version for Kalashnikov rifles (see FIG. 3), attaches by the fore and aft ends of the hand guard, inserting into the hand guard retainers that are already present on the rifle. This invention is not limited to any particular attachment method, or use on any particular firearm, but rather can be manufactured for use on any firearm, with the attachment method of any model or variation being specific to the firearm it is intended to mount upon.

A hand guard of a firearm for receiving an accessory of the firearm includes: one or more Picatinny accessory rails running longitudinally along a barrel of the firearm; a linear cavity parallel to the barrel of the firearm and parallel to an accessory receiving surface of the one or more Picatinny accessory rails; the one or more Picatinny accessory rails including one or more through holes fluidly connecting the linear cavity to the accessory receiving surface; and wherein the one or more Picatinny accessory rails includes a flange facing toward the linear cavity and running parallel to the barrel of the firearm, the flange including a track with a flat surface as a guide for a nut or ferrule for attaching the accessory of the firearm to the one or more Picatinny accessory rails of the hand guard. The hand guard may further comprise two or more recoil lugs located adjacent to each of the one or more through holes. The one or more through holes may pass between the two or more recoil lugs. A distance between the flat surface and the accessory receiving surface may be between 0.140 and 0.155 of an inch. Two or more Picatinny accessory rails may run longitudinally along the barrel of the firearm. Three or more Picatinny accessory rails may run longitudinally along the barrel of the firearm. Four or more Picatinny accessory rails may run longitudinally along the barrel of the firearm. The hand guard may further comprise one or more inwardly recessed accessory rails running longitudinally along a barrel of the firearm. The one or more inwardly recessed accessory rails may include one or more through holes connecting a linear cavity between the barrel of the firearm and an external surface of the hand guard. Two or more inwardly recessed accessory rails may run longitudinally along a barrel of the firearm. Three or more inwardly recessed accessory rails may run longitudinally along a barrel of the firearm. Four or more inwardly recessed accessory rails may run longitudinally along a barrel of the firearm. The one or more Picatinny accessory rails may allow a clamped firearm accessory and a through-hole bolted firearm accessory to be attached to the firearm using the one or more adjacent Picatinny accessory rails. A fore most and aft most edge of the one or more through holes may fall within or immediately adjacent to a recoil lug with a minimum of 0.030 of an inch from the recoil groove. The hand guard may be constructed of aluminum, fiber glass, plastics, elastomeric compounds, polymer based materials, metals, alloys, or a combination thereof. The one or more through holes of the one or more Picatinny accessory rails may be one or more through hole slots. The one or more through holes of the one or more inwardly recessed accessory rails may be one or more through hole slots. The hand guard may be constructed of integrally formed molded material. The hand guard may be constructed of integrally formed alloyed material. The hand guard may be constructed of an integrally formed extruded, machined, and/or cast material.

BRIEF DESCRIPTION OF THE DRAWINGS

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limiting of its scope, the invention will be described and explained with additional specificity and detail through use of the accompanying drawings, in which.

DETAILED DESCRIPTION

It will be readily understood that the components of the present invention, as generally described and illustrated in the Figures herein, could be arranged and designed in a wide variety of different configurations. Thus, the following more detailed description of the embodiments of the invention, as represented in the Figures, is not intended to limit the scope of the invention, but is merely representative of certain examples of presently contemplated embodiments in accordance with the invention. The presently described embodiments will be best understood by reference to the drawings.

Figure 1:
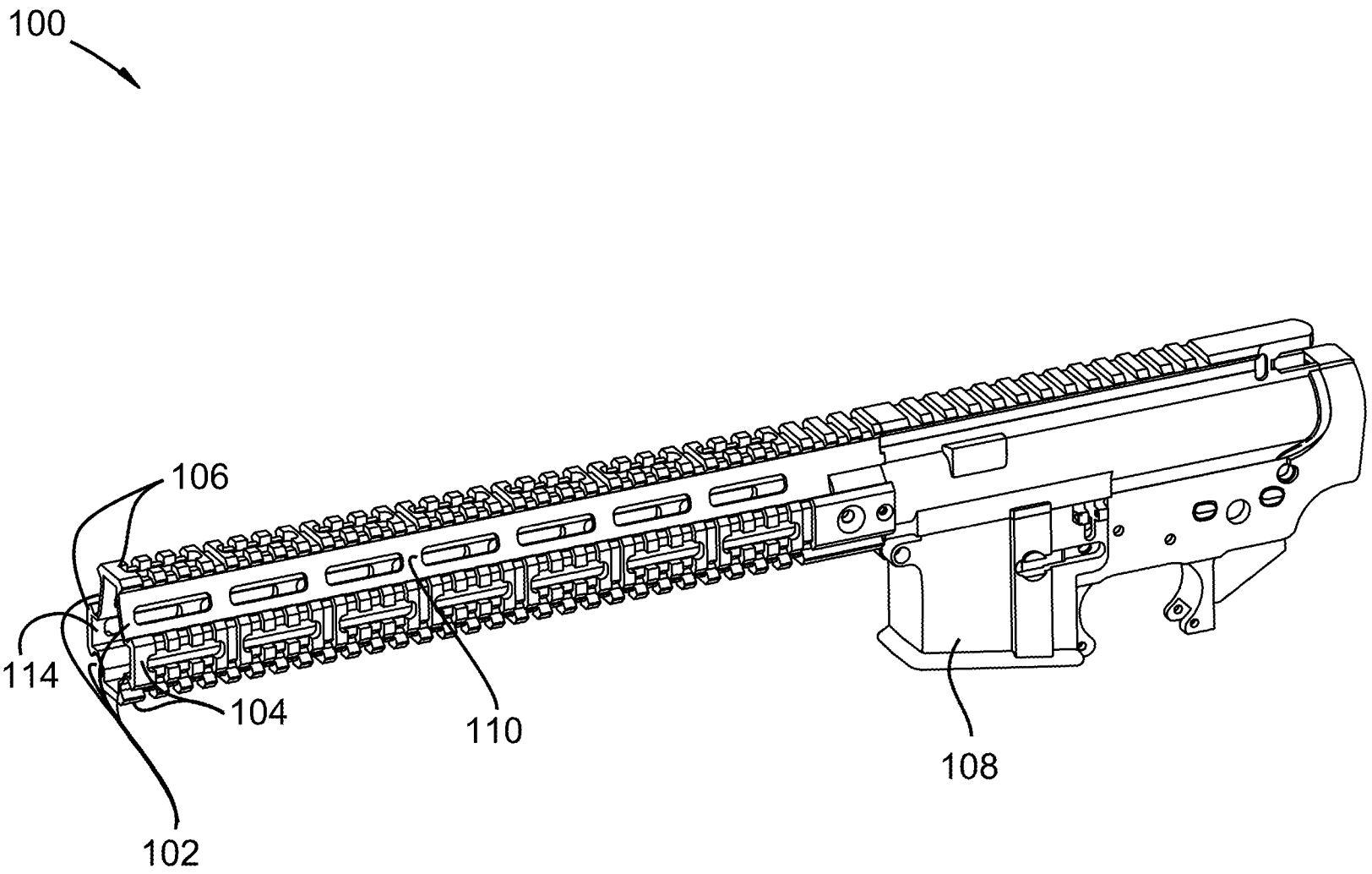
FIG. 1 shows a hand guard firearm accessory in accordance with an embodiment of the invention.

FIG. 1 shows a hand guard firearm accessory 100 in accordance with an embodiment of the invention. Hand guard firearm accessory 100 includes one or more inner accessory rails 102 formed as inner rails between outer accessory rails 104, 106. This invention consists of a hand guard for a firearm, which partially, or completely surrounds the barrel of a firearm, that has accessory mounting rails (henceforth referred to as rails) around its perimeter running lengthwise parallel or near parallel with the barrel of the firearm, rails 106. These rails are typically, but not limited to being, placed at the 3:00, 6:00, 9:00 and sometimes 12:00 position. FIG. 1 shows four inner rails 102 positioned between four outer rails 104,106. Hand guard firearm accessory 100 may optionally include a main body portion 108 for interfacing with components of a firearm. Inner rails 102 and/or outer rails 104/106 may be used individually or in combination to accessorize a firearm using firearm accessory 100 as a precision mounting point. Inner rails 102 and/or outer rails 104/106 may contain one or more through holes with recessed flanges 110,114. The recessed flanges allow fasteners and accessories to be precision aligned and positioned with a parallel direction of a long direction of firearm accessory 100 without interfering with a barrel of a firearm 1. Firearm accessory 100 may be made as one integrally formed component or may be formed of two or more components. Firearm accessory 100 may be constructed of aluminum, fiber glass, plastics, elastomeric compounds, polymer based materials, metals, alloys, or a combination thereof.

Figure 2:
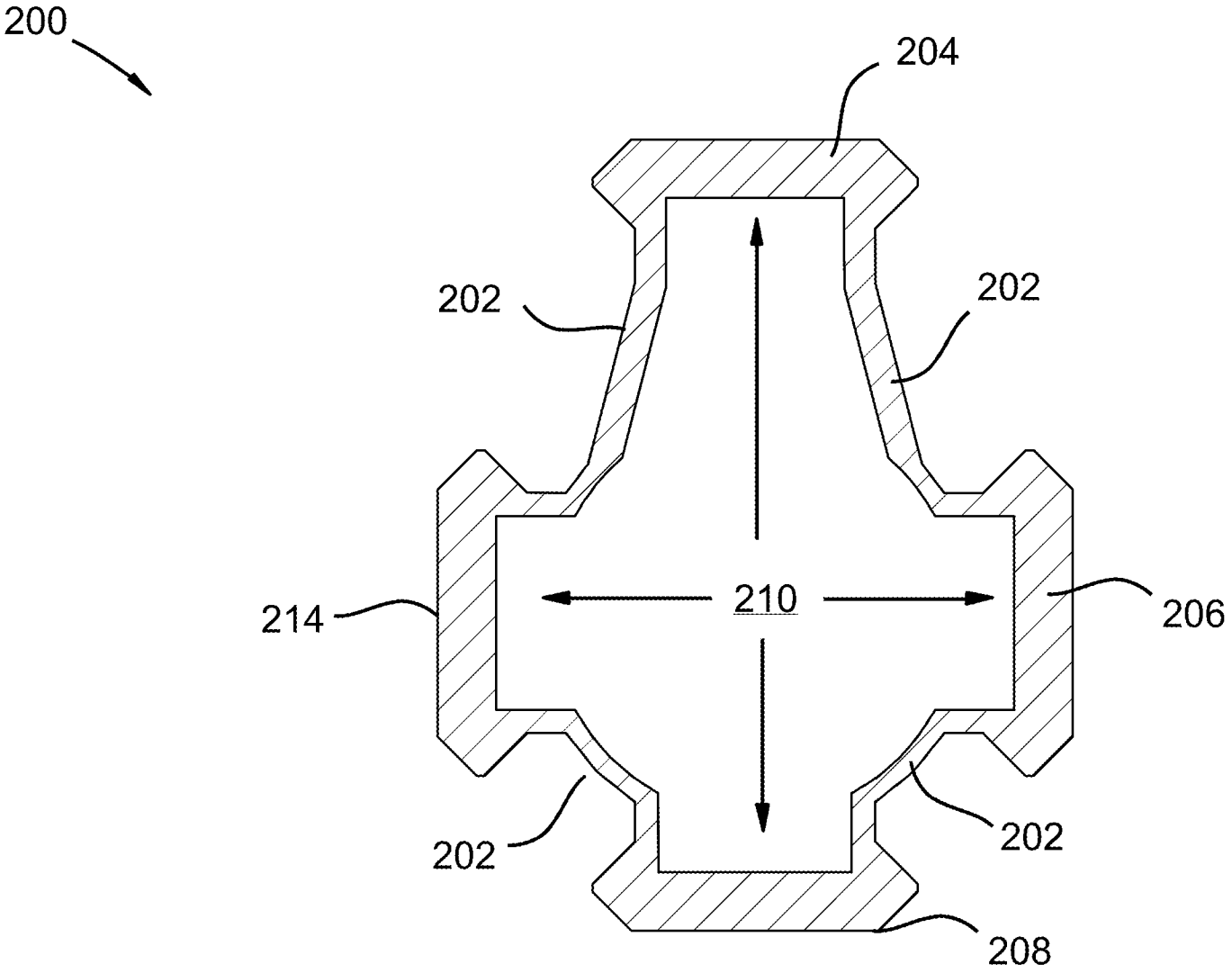
FIG. 2 shows a perpendicular cross-section of a hand guard firearm accessory in accordance with an embodiment of the invention.

FIG. 2 shows a perpendicular cross-section 200 of a hand guard firearm accessory in accordance with an embodiment of the invention. The outer profile of the rails contains a dovetail, which conforms to MIL-STD-1913 specifications (see FIG. 2, outer rails 204, 206, 208, and 214). The outermost plane of this profile can be positioned as close as 0.7845" from the centerline of the barrel. The inner profile creates a linear cavity (see FIG. 2, linear cavity 210) that can be used to house a nut or ferrule, for an accessory, or accessory bolt to thread into. Cross-section 200 includes inner rails 202 and outer rails 204, 206, 208, and 214. Inner rails 202 and outer rails 204, 206, 208, and 214 may contain one or more through holes with recessed flanges (shown in FIG. 4). The recessed flanges allow fasteners and accessories to be precision aligned and positioned with a parallel direction of a long direction of firearm accessory 200 without interfering with a barrel of a firearm. An inner area 210 is formed by the inner and outer rails around a barrel of a firearm. The inner and outer rails form a hand guard and accessory mounts around a firearm barrel. Inner rails 202 and/or outer rails 204, 206, 208, and 214 may be used individually or in combination to accessorize a firearm. Firearm accessory 200 may be made as one integrally formed component or may be formed of two or more components. Firearm accessory 200 may be constructed of aluminum, fiber glass, plastics, elastomeric compounds, polymer based materials, metals, alloys, or a combination thereof.

Figure 3:
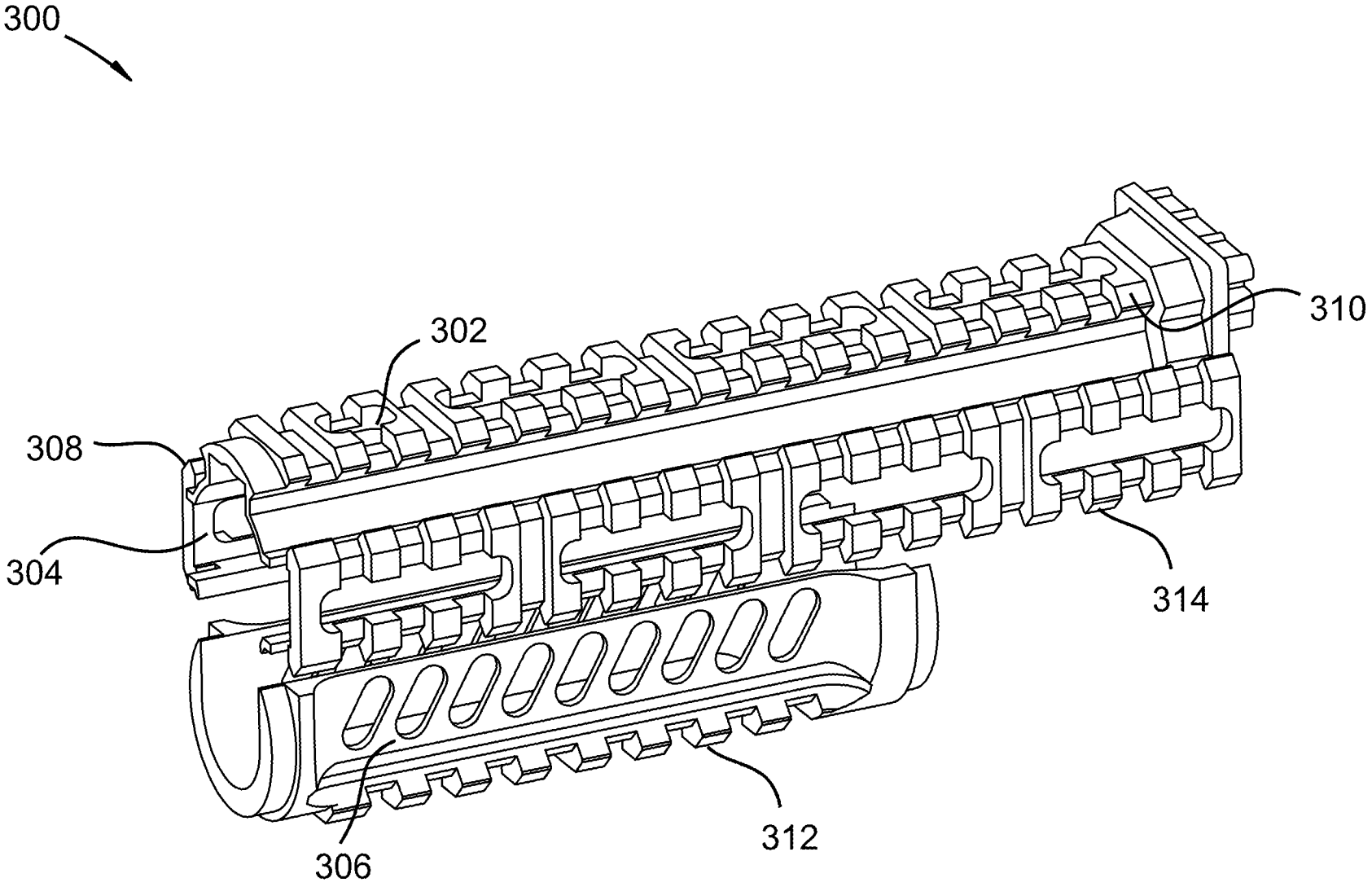
FIG. 3 shows a hand guard firearm accessory in accordance with an embodiment of the invention.

FIG. 3 shows a hand guard firearm accessory 300 in accordance with an embodiment of the invention. Hand guard firearm accessory 300 includes one or more inner accessory rails 306 formed as inner rails between outer accessory rails 314, 312. Additional inner rails may be positioned between other outer rails such as outer rails 308, 302, for example. Hand guard firearm accessory 300 may optionally include a main body portion (not shown) for interfacing with components of a firearm or may be used as a firearm barrel attachment. Inner rails 304, 306 and/or outer rails 302, 308, 310, 314, and 316 may be used individually or in combination to accessorize a firearm using firearm accessory 300 as a precision mounting point. Inner rails 304/306 and/or outer rails 302, 308, 310, 314, and 316 may contain one or more through holes with recessed flanges. The recessed flanges allow fasteners and accessories to be precision aligned and positioned with a parallel direction of a long direction of firearm accessory 300 without interfering with a barrel of a firearm. Firearm accessory 300 may be made as one integrally formed component or may be formed of two or more components. Firearm accessory 300 may be constructed of aluminum, fiber glass, plastics, elastomeric compounds, polymer based materials, metals, alloys, or a combination thereof.

Figure 4:
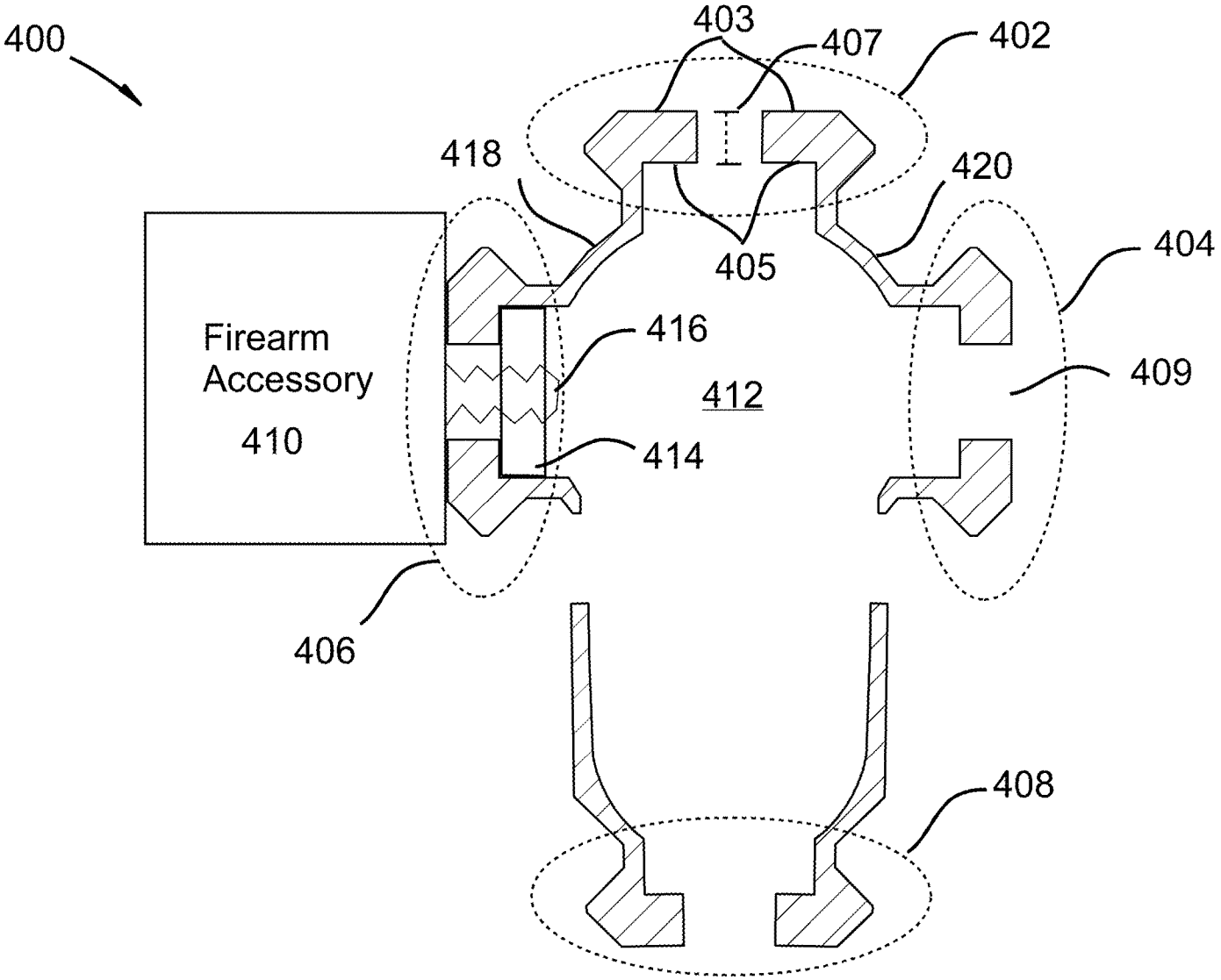
FIG. 4 shows a cross-section of a hand guard firearm accessory in accordance with an embodiment of the invention.

FIG. 4 shows a cross-section 400 of a hand guard firearm accessory in accordance with an embodiment of the invention. Cross-section 400 includes inner recessed rails 408, 404 and rails 404, 406, 410, and 414. Inner recessed rails 418/420 and/or Picatinny rails 402, 404, 406, and 408 may contain one or more through holes 409 on each rail 402, 404, 406, 408, 418, and 420 for mounting firearm accessories 410 according to the M-LOK standard and/or the MIL-STD-1913. The recessed flanges 405 allow fasteners 414/416 and firearm accessories 410 to be precision aligned and positioned in a parallel direction of a long direction of hand guard firearm accessory 400 without interfering with a barrel of a firearm. Adjacent Picatinny rails typically placed 90 degrees apart need to be between 0.95 and 1.25 inches out from center in order to allow clamp-on accessories to be mounted adjacently to each other. By adding the through holes, adjacent Picatinny rails can be from 0.75 to 1.25 inches and still allow adjacent mounting by using one or more through bolt accessories. The holes or slots 409 may be centered laterally on the rails, with the lateral width of the slots being narrower than the linear cavity 412 created by the inner profile of the rail, by enough margin, that a nut or ferrule 414 placed inside the linear cavity can purchase on the material 403/405 between the lateral edges of the hole or slot and the inner profile of the rail lateral edges, lips, or flanges 405, to prevent the nut or ferrule 414 from pulling through the hole 409. A distance 407 between the flat flange track surface 405 and the accessory receiving surface 403 is between 0.140 and 0.155 of an inch with a preferred distance of 0.150 of an inch. Inner rails 418/420 and/or Picatinny rails 402-408 may also each contain recessed flanges similar to 405 allowing fasteners and accessories to be precision aligned and positioned in a parallel direction of a long direction of firearm accessory 400 without interfering with a barrel of a firearm. An inner area 412 is formed by the inner and outer rails around a barrel of a firearm. The inner and outer rails form a hand guard and accessory mounts around a firearm barrel. Inner rails 408/404 and/or outer Picatinny rails 402-408 may be used individually or in combination to accessorize a firearm using firearm accessory 400 as a precision mounting point. Advantage are realized in off center spacing when mount adjacent accessories using both the through hole configuration and the Picatinny rail. Firearm accessory 400 may be made as one integrally formed component or may be formed of two or more components. Firearm accessory 400 may be constructed of aluminum, fiber glass, plastics, elastomeric compounds, polymer based materials, metals, alloys, or a combination thereof.

Figure 5:
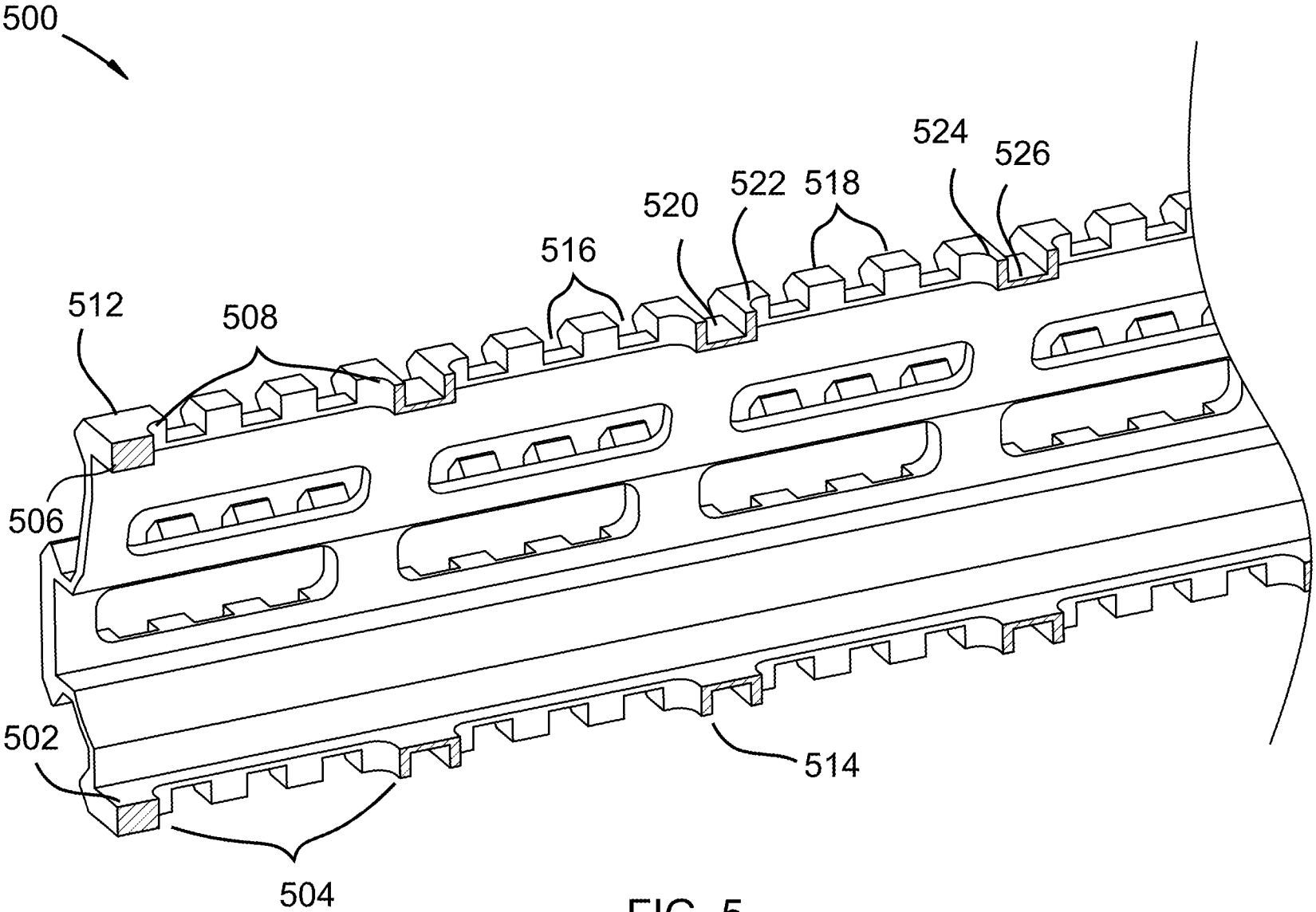
FIG. 5 shows a partial parallel cross-section of a hand guard firearm accessory in accordance with an embodiment of the invention.

FIG. 5 shows a partial parallel cross-section of a hand guard firearm accessory in accordance with an embodiment of the invention. Outer rails 512/514 may contain one or more through holes 508 with recessed flanges 502/506. The recessed flanges 502/506 allow fasteners and accessories to be precision aligned and positioned with a parallel direction of a long direction of firearm accessory 500 without interfering with a barrel of a firearm. Flanges 502/506 included lips 502/506 on an inner surface of outer rails 512/514. The rails have a series of lateral "recoil grooves", recoil grooves 516 formed into them with a longitudinal center to center spacing of 0.394" between each adjacent groove 516. Each of these grooves is considered an attachment position for an accessory. The material fore and aft of each recoil groove shall be considered "recoil lugs", recoil lugs 518. The rails have a series of holes or slots, running longitudinally, with all or part of a recoil lug immediately fore and aft of the front and rear edges of all holes or slots 508. A fore most edge 522 and aft most edge 524 of the one or more through holes/slots fall within or immediately adjacent to a recoil lug with a minimum of 0.030 of an inch from the recoil groove

520/526. The holes or slots are centered laterally on the rails, with the lateral width of the slots being narrower than the linear cavity created by the inner profile of the rail, by enough margin, that a nut or ferrule placed inside the linear cavity can purchase on the material between the lateral edges of the hole or slot and the inner profile of the rail lateral edges or lips 502/506, to prevent the nut or ferrule from pulling through the hole. The lips 502/506 form part of the flange which allows precision alignment and positioning of firearm accessories attached to firearm accessory 500. Firearm accessory 500 may be made as one integrally formed component or may be formed of two or more components. Firearm accessory 500 may be constructed of aluminum, fiber glass, plastics, elastomeric compounds, polymer based materials, metals, alloys, or a combination thereof.

The systems and methods disclosed herein may be embodied in other specific forms without departing from their spirit or essential characteristics. The described embodiments are to be considered in all respects only as illustrative and not restrictive. All changes which come within the meaning and range of equivalency of the claims are to be embraced within their scope.

The invention claimed is:

1. A hand guard of a firearm for receiving an accessory of the firearm comprising:

one or more Picatinny accessory rails running longitudinally along a barrel of the firearm;

a linear cavity parallel to the barrel of the firearm and parallel to an accessory receiving surface of the one or more Picatinny accessory rails;

the one or more Picatinny accessory rails including one or more through holes fluidly connecting the linear cavity to the accessory receiving surface;

wherein the one or more Picatinny accessory rails includes a flange facing toward the linear cavity and running parallel to the barrel of the firearm, the flange including a track with a flat surface as a guide for a nut or ferrule for attaching the accessory of the firearm to the one or more Picatinny accessory rails of the hand guard;

wherein a fore most and aft most edge of the one or more through holes fall within or immediately adjacent to a recoil lug with a minimum of 0.030 of an inch from the recoil groove; and wherein a distance between the flat surface and the accessory receiving surface is between 0.140 and 0.155 of an inch.

2. The hand guard of claim 1, further comprising two or more recoil lugs located adjacent to each of the one or more through holes.

3. The hand guard of claim 2, wherein the one or more through holes pass between the two or more recoil lugs.

4. The hand guard of claim 1, wherein two or more Picatinny accessory rails run longitudinally along the barrel of the firearm.

5. The hand guard of claim 1, wherein three or more Picatinny accessory rails run longitudinally along the barrel of the firearm.

6. The hand guard of claim 1, wherein four or more Picatinny accessory rails run longitudinally along the barrel of the firearm.

7. The hand guard of claim 1, further comprising one or more inwardly recessed accessory rails running longitudinally along a barrel of the firearm.

8. The hand guard of claim 7, wherein the one or more inwardly recessed accessory rails include one or more through holes connecting a linear cavity between the barrel of the firearm and an external surface of the hand guard.

9. The hand guard of claim 8, wherein two or more inwardly recessed accessory rails run longitudinally along a barrel of the firearm.

10. The hand guard of claim 8, wherein three or more inwardly recessed accessory rails run longitudinally along a barrel of the firearm.

11. The hand guard of claim 8, wherein four or more inwardly recessed accessory rails run longitudinally along a barrel of the firearm.

12. The hand guard of claim 8, wherein the one or more through holes of the one or more inwardly recessed accessory rails are one or more through hole slots.

13. The hand guard of claim 1, wherein the one or more Picatinny accessory rails allows a clamped firearm accessory and a through-hole bolted firearm accessory to be attached to the firearm using the one or more adjacent Picatinny accessory rails.

14. The hand guard of claim 1, wherein the hand guard is constructed of aluminum, fiber glass, plastics, elastomeric compounds, polymer based materials, metals, alloys, or a combination thereof.

15. The hand guard of claim 1, wherein the one or more through holes of the one or more Picatinny accessory rails are one or more through hole slots.

16. The hand guard of claim 1, wherein the hand guard is constructed of integrally formed molded material.

17. The hand guard of claim 1, wherein the hand guard is constructed of integrally formed alloyed material.

18. The hand guard of claim 1, wherein the hand guard is constructed of an integrally formed extruded, machined, and/or cast material.

* * * * *